US006405953B1

(12) United States Patent
Warren

(10) Patent No.: US 6,405,953 B1
(45) Date of Patent: Jun. 18, 2002

(54) IMPELLER SHOE FOR AN IMPACT CRUSHER

(75) Inventor: Kenneth D. Warren, Spokane, WA (US)

(73) Assignee: Impact Service Corporation, Spokane, WA (US)

( * ) Notice: Subject to any disclaimer, the term of this patent is extended or adjusted under 35 U.S.C. 154(b) by 0 days.

(21) Appl. No.: 09/365,354

(22) Filed: Jul. 30, 1999

(51) Int. Cl.[7] ..... B02C 19/00
(52) U.S. Cl. ..... 241/275; 164/98
(58) Field of Search ..... 241/275; 164/98

(56) References Cited

U.S. PATENT DOCUMENTS

| | | | |
|---|---|---|---|
| 1,857,539 | A | 5/1932 | Hadsel |
| 2,637,502 | A | 5/1953 | Bond |
| 2,992,783 | A | 7/1961 | Wirth et al. |
| 2,992,784 | A | 7/1961 | Behnke et al. |
| 3,058,679 | A | 10/1962 | Adams |
| 3,074,657 | A | 1/1963 | Bridgewater |
| 3,162,386 | A | 12/1964 | Danyluke |
| 3,346,203 | A | 10/1967 | Danyluke |
| 3,767,127 | A | 10/1973 | Wood |
| 4,174,814 | A | 11/1979 | Warren et al. |
| 4,355,769 | A | 10/1982 | Warren et al. |
| 4,738,403 | A | 4/1988 | Sevelinge |
| 4,784,339 | A | 11/1988 | Deffenbaugh |
| 4,787,564 | A | 11/1988 | Tucker |
| 4,796,822 | A | 1/1989 | Terrenzio |
| 4,940,188 | A | 7/1990 | Rodriguez et al. |
| 5,863,006 | A | 1/1999 | Thrasher |
| 5,921,484 | A | 7/1999 | Smith et al. |

FOREIGN PATENT DOCUMENTS

| | | |
|---|---|---|
| AU | 240323 | 4/1962 |
| DE | 31 16159 | 9/1982 |
| EP | 0 101 277 | 2/1984 |
| EP | 0 276 848 | 8/1988 |
| EP | 0 452 590 | 10/1991 |
| EP | 0 607 977 | 7/1994 |
| GB | 2 214 107 | 8/1989 |

*Primary Examiner*—Mark Rosenbaum
(74) *Attorney, Agent, or Firm*—Christensen O'Connor Johnson Kindness PLLC

(57) ABSTRACT

An impeller shoe (70) comprising an elongated body (72) of abrasion-resistant material extending longitudinally from an inner end (74) to an outer end (76) and having a pocket (84, 86) defined in the elongated body (72). The pocket (84, 86) has an open end at the front (80) of the elongated body (72) and two opposing sides (88, 90 and 92, 94) extending transversely through the elongated body (72) toward the back (78) of the body. The two sides (88, 90 and 92, 94) of the pocket (84, 86) are oriented substantially parallel to each other and set at an angle with respect to the plane (108) of the back of the body in a direction toward the inner end (74). The pockets (84, 86) also have a substantially even width measured between the two sides (88, 90 and 92, 94) through the length of the pockets. To further extend the wear life of an impeller shoe (104), one or more rods (106) made of higher abrasion-resistant material may be embedded within the impeller shoe (104).

19 Claims, 6 Drawing Sheets

Fig. 7
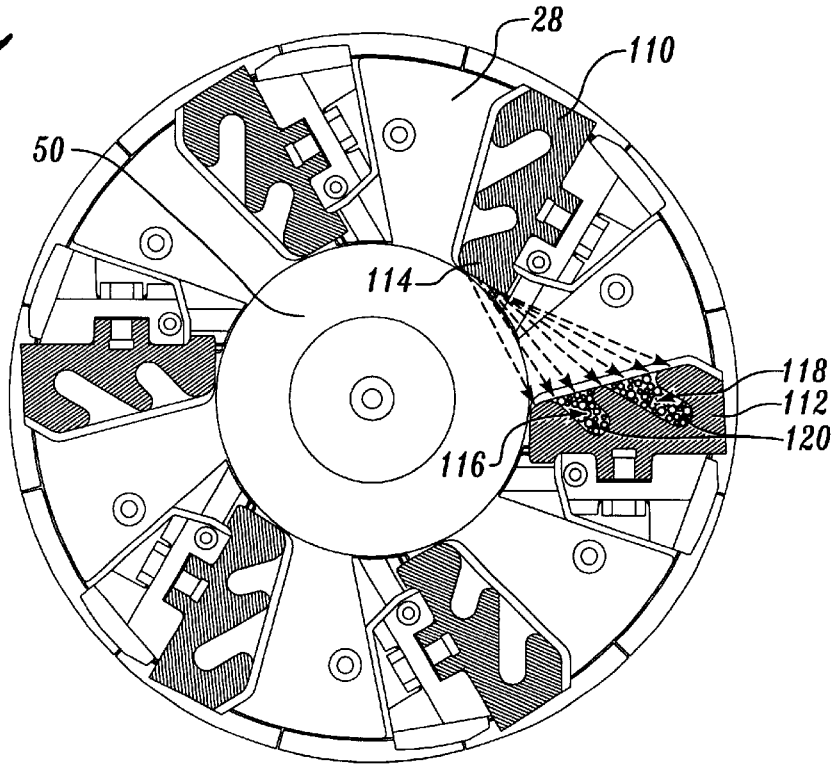
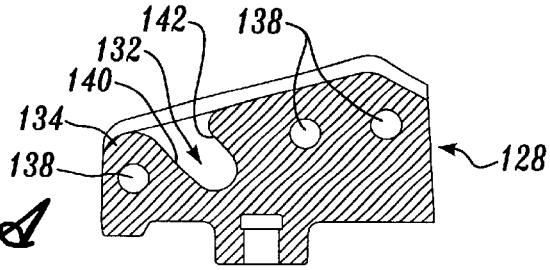
Fig. 8A
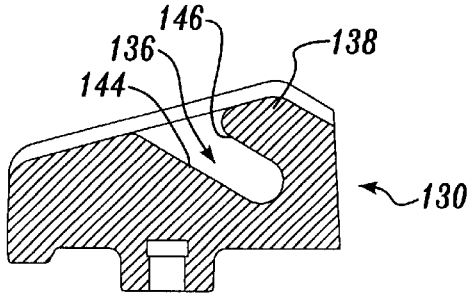
Fig. 8B
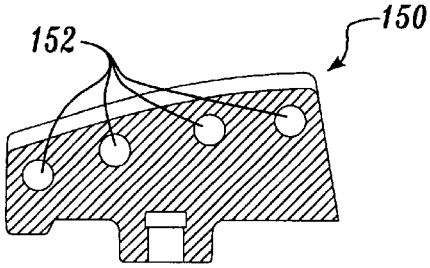
Fig. 9

IMPELLER SHOE FOR AN IMPACT CRUSHER

FIELD OF THE INVENTION

This invention relates generally to impact crushing machines, and more particularly, to impeller shoes for use in such machines.

BACKGROUND OF THE INVENTION

Impact crushing machines are used to crush particulate matter, such as rock, into smaller aggregate material. In a vertical shaft impact crushing machine, particulate material is fed centrally downward through a feed tube and onto a horizontal impeller table assembly that is rotating about a vertical axis at a high speed. Impeller shoes mounted to the table assembly impact the particulate material and cause the particulate material to break into smaller aggregate material. The impeller shoes also cause the particulate material to accelerate radially outward from the table assembly at a very high velocity to impact against stationary anvil members positioned around the table assembly. When the aggregate material impacts the anvil members, the deceleration forces cause the aggregate material to further break apart into smaller pieces.

One of the principal concerns of operating impact crushing machines is the extensive wear of the parts in the crushing chamber, particularly, the impeller shoes. It is not unusual for impeller shoes to require replacement after 14 hours of operation. Frequent replacement of the impeller shoes imposes substantial costs, not only in the cost of the wear parts themselves but also the downtime for the equipment.

To increase wear life, various prior art impeller shoes have included pockets that collect crushed aggregate material during the crushing operation. The aggregate material in the pockets forms a surface that impacts the particulate material fed into the crushing machine and partially shields the impeller shoe. This aggregate-on-aggregate action is intended to reduce the wear of the impeller shoe.

One design for prior art impeller shoes is illustrated in FIG. 1, which shows an impeller table assembly 10 with the prior art impeller shoes 12 mounted thereon. The flow of aggregate material 14 between two impeller shoes on the table assembly as the table assembly rotates is shown by arrowed lines 16. Unfortunately, prior art pocket designs, such as that shown in FIG. 1, require moisture in the aggregate material 14 to improve the packing of the aggregate material 14 in the pockets. Without moisture, dry aggregate material does not fully pack in the pockets, thus increasing the exposure and subsequent wear of the impeller shoe. While moisture improves the packing of the aggregate material 14, it is also known that moisture adds to the abrasive characteristic of the aggregate material, thus defeating to a certain degree the benefit of including pockets in the impeller shoes 12. Furthermore, prior art pocket designs have limited the feed size of the particulate material to a smaller size due to the lighter weight and less-sturdy shape of the impeller shoe (i.e., compared to the feed size that a solid impeller shoe can handle).

What is needed, therefore, is an impeller shoe that incorporates pockets capable of packing crushed material without moisture and has the sturdiness and crushing capacities as such found in a solid impeller shoe. The impeller shoe of the present invention is directed to satisfy these needs and other deficiencies of the prior art.

SUMMARY OF THE INVENTION

The present invention is an impeller shoe comprising an elongated body of abrasion-resistant material. The elongated body of the impeller shoe extends longitudinally from an inner end to an outer end and has a pocket defined therein. The pocket has an open end at the front of the elongated body and two opposing sides extending transversely through the elongated body toward the back of the body. The two sides of the pocket are oriented substantially parallel to each other and set at an angle with respect to the back of the body in a direction toward the inner end. The pocket also has a substantially even width measured between the two sides through the length of the pocket.

An impeller shoe constructed in accordance with the present invention does not weigh substantially less than a solid impeller shoe and enjoys a sturdiness and crushing capacity greater than prior art pocketed impeller shoes. Moreover, the pockets are capable of fully packing with dry aggregate material during a crushing operation, and the impeller shoe maintains a wider wear pattern top to bottom over time as compared to prior art impeller shoes.

To further extend the wear life of an impeller shoe, the present invention also includes embedding one or more rods made of higher abrasion-resistant material, such as carbide or ceramic, in the impeller shoe. The rods are held in place by the material of the impeller shoe and are exposed when the outer material of the impeller shoe is worn away.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 7 is a top view of an impeller table with a section view of impeller shoes formed according to the present invention mounted thereon;

FIG. 8A is a top section view of an impeller shoe constructed in accordance with the present invention that includes a single pocket near the inner end and abrasion-resistant rods inserted in the impeller shoe;

FIG. 8B is a top section view of an impeller shoe constructed in accordance with the present invention that includes a single pocket near the outer end; and FIG. 9 is a top section view of a solid impeller shoe that includes one or more abrasion-resistant rods inserted in the impeller shoe in accordance with the present invention.

DETAILED DESCRIPTION OF THE PREFERRED EMBODIMENT

Figure 2:
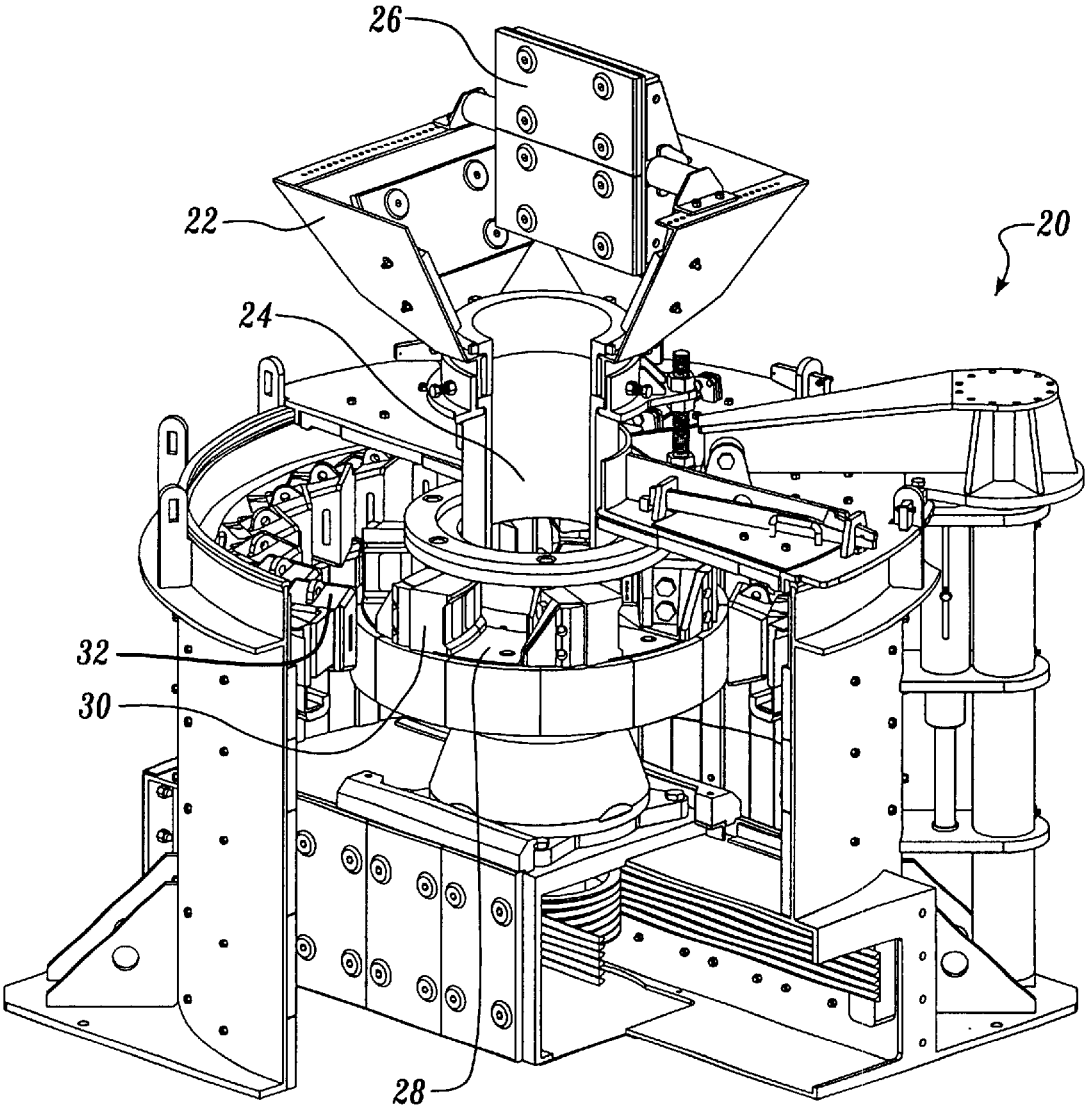
FIG. 2 is a perspective view of a vertical shaft impact crushing machine, with a quarter section of the machine removed to reveal the internal components of the crushing machine.

An impeller shoe formed in accordance with the present invention is particularly suited for use in a vertical shaft impact crushing machine 20 of the type shown in FIG. 2. While a vertical shaft impact crushing machine 20 is often spoken of in terms of crushing rock, it should be recognized that a crushing machine of the type shown in FIG. 2 is equally capable of crushing glass, brick, concrete, asphalt, and other material.

Referring to FIG. 2, particulate material fed into the crushing machine 20 enters through a feed box 22 connected to a feed tube 24. An adjustable feed splash plate 26 may be used to guide the material fed into the crushing machine 20. The particulate material descends through the feed tube 24 and falls onto an impeller table 28 that is rotating at a high speed. Impeller shoes 30 mounted on the impeller table 28 impact and crush the particulate material into aggregate, and cause the aggregate material to accelerate radially outward at a very high velocity. The aggregate material impacts against stationary wear-resistant anvils 32 positioned around the rotating impeller table 28, causing the aggregate material to further break into smaller-sized material. The aggregate material then drops and is conveyed away from the crushing machine 20.

Figure 3:
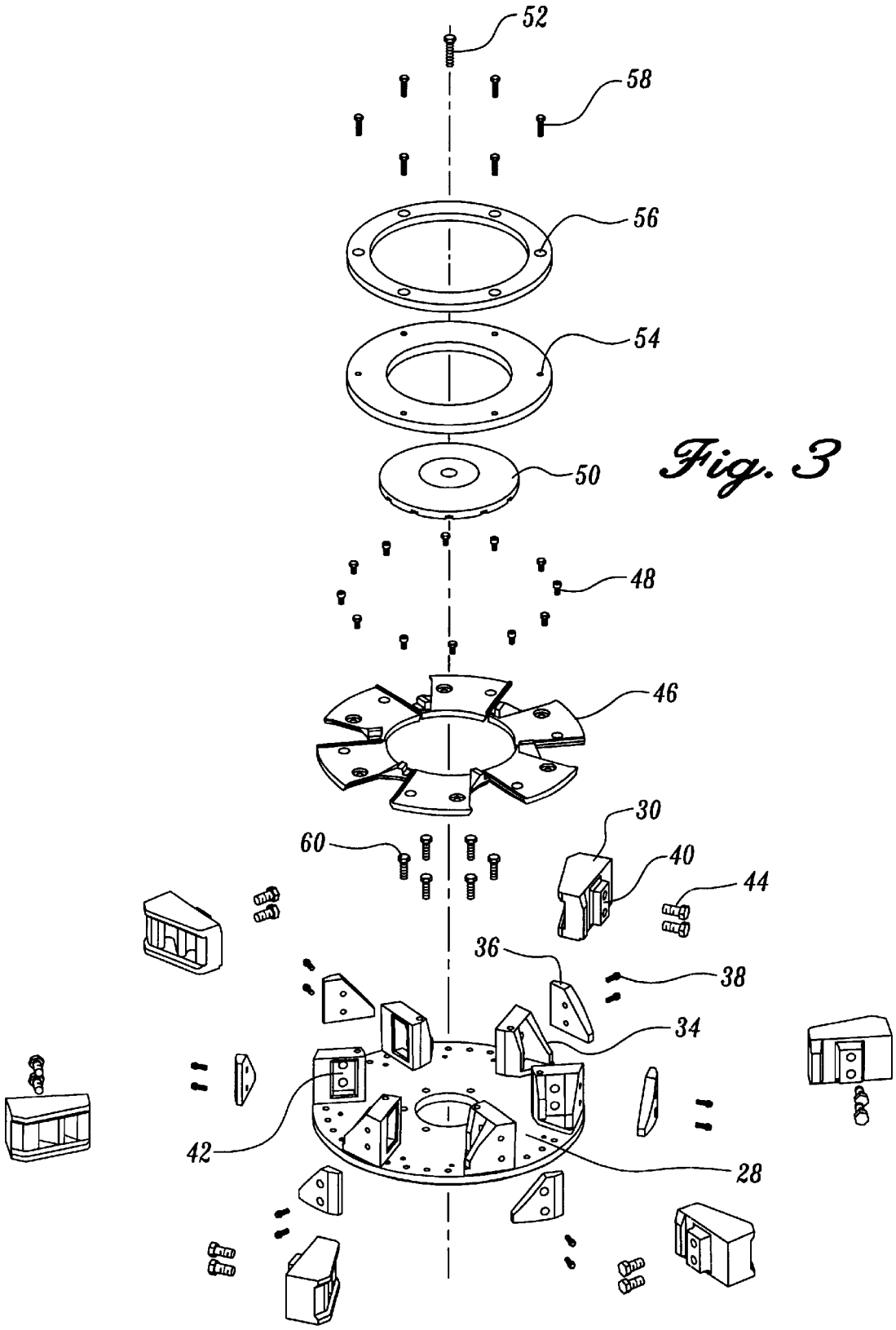
FIG. 3 is an exploded perspective view of the impeller table and impeller shoes in the vertical shaft impact crushing machine shown in FIG. 2.

An exploded view of the impeller table 28 and impeller shoes 30 shown in FIG. 2 is illustrated in FIG. 3. Brackets 34 for holding the impeller shoes 30 are secured to the impeller table 28. Cast liners 36 are mounted to the outside of the brackets 34 by bolts 38 to protect the brackets 34 from wear during the crushing action of the machine 20.

Each impeller shoe 30 includes a stob 40 projecting from the rear of the impeller shoe that mates with a recess 42 in the brackets 34. Bolts 44 inserted through the back side of the recess 42 into the stob 40 secure the impeller shoes 30 to the brackets 34.

To protect the impeller table 28 from wear during the crushing action of the machine 20, a flat cast liner 46 is attached to the impeller table 28 by bolts 48. A feed disc 50 is also secured to the impeller table 28 by bolt 52. An annular top table plate 54 and bolt plate 56 are secured by bolts 58 to the top surface of the brackets 34. Particulate material fed into the crushing machine 20 passes through the annular bolt plate 56 and top table plate 54 onto the feed disc 50, spins outward to be impacted by the impeller shoes 30, and accelerates further outward to impact stationary anvils 32 (not shown in FIG. 3) surrounding the impeller table 28.

Figure 4A:
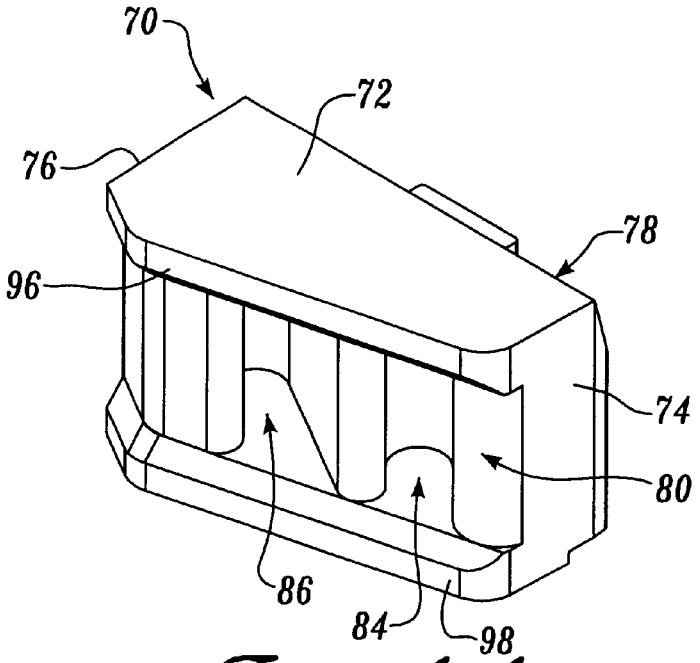
FIG. 4A is a front perspective view and FIG. 4B is a rear perspective view of an impeller shoe constructed in accordance with the present invention and shown in FIG. 3.
Figure 4B:
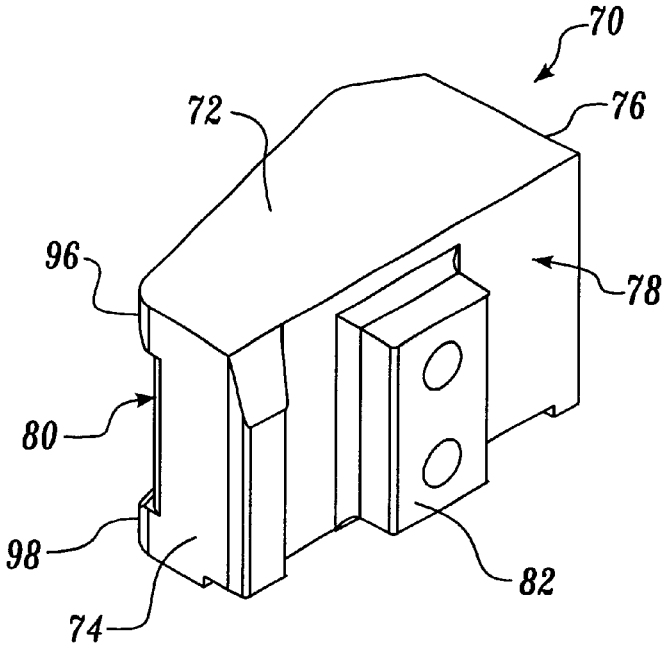

FIG. 4A is a front perspective view and FIG. 4B is a rear perspective view of an impeller shoe 70 constructed in accordance with the present invention. The impeller shoe 70 is formed of an elongated body 72 comprised of an abrasive-resistant material, preferably a cast chromium alloy or other wear-resistant alloy. Other forming means such as cutting or machining, and other wear-resistant material such as ceramic, may be used in forming the elongated body 72 of the impeller shoe 70.

The elongated body 72 extends longitudinally from an inner end 74 to an outer end 76. When mounted on an impeller table 28, the inner end 74 is positioned near the feed disc 50 (see FIG. 7) while the outer end 76 is positioned toward the edge of the impeller table 28. The elongated body 72 further includes a back 78 and a front 80 extending longitudinally between the inner end 74 and the outer end 76. The back 78 of the elongated body 72, as shown in FIG. 4B, preferably includes a stob 82 that secures within a recess in a bracket when the impeller shoe 70 is mounted on the impeller table 28, as described earlier in reference to FIG. 3.

Figure 5:
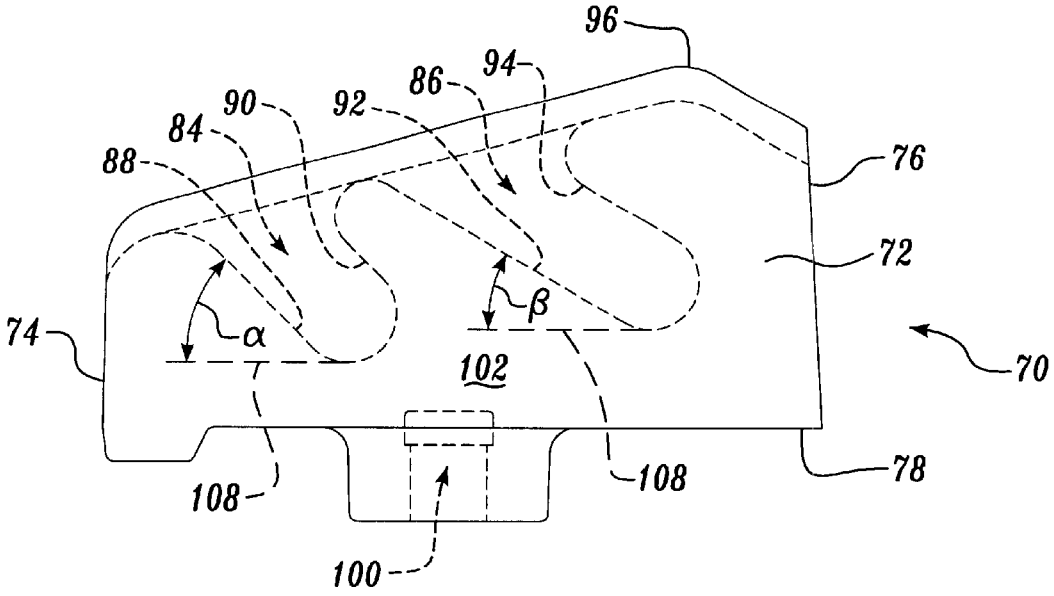
FIG. 5 is a top view of the impeller shoe shown in FIGS. 4A and 4B.

The impeller shoes shown in FIGS. 4–8 include at least one pocket defined in the elongated body of the shoe. In particular, the impeller shoe 70 shown in FIG. 4A includes a first pocket 84 and a second pocket 86. The pockets 84, 86 have an open end at the front 80 of the elongated body and extend transversely inward from the front 80 of the elongated body 72 toward the back 78. As shown in FIG. 5, discussed below, the two opposing sides 88, 90 and 92, 94 of each pocket 84, 86 are preferably substantially parallel to each other and extend with a substantially even width (measured between the opposing sides) into the elongated body 72. The two sides 88, 90 and 92, 94 of each pocket 84, 86 are also oriented at an angle with respect to the plane of the back 78 of the elongated body 72 in a direction toward the inner end 74 of the elongated body 72. Oriented in this manner, the pockets 84, 86 face the flow of aggregate material (see FIG. 7) that fully packs the pockets 84, 86 when the impeller shoe 70 is mounted on an impeller table 28 and used in a crushing machine 20.

As shown in FIG. 4A, a preferred embodiment of the impeller shoe further includes upper and lower lips 96 and 98, respectively, extending longitudinally along the front top and bottom edges of the elongated body 72. The upper and lower lips 96, 98 extend transversely outward from the front 80 and are useful for guiding aggregate material along the front 80 of the impeller shoe.

Figure 6:
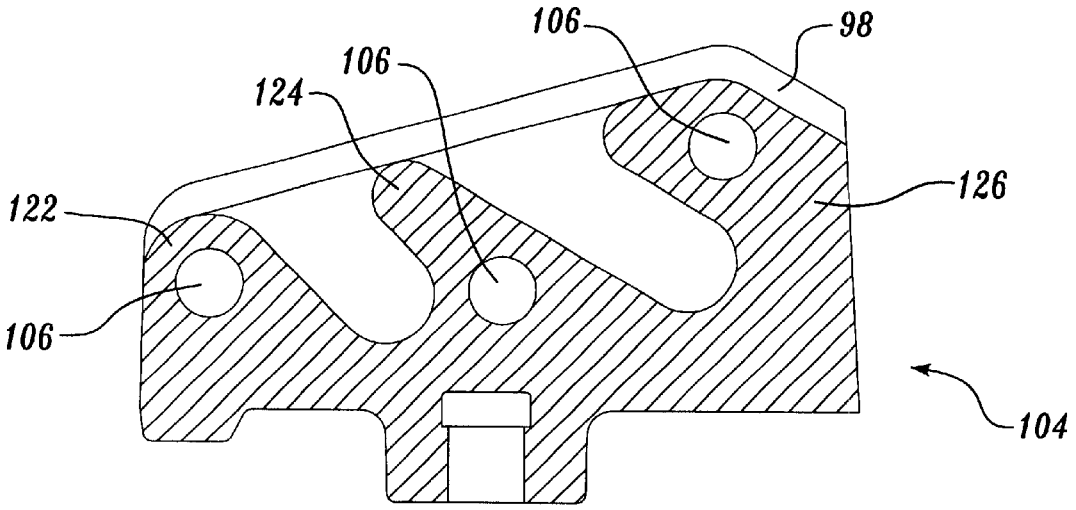
FIG. 6 is a top section view of an impeller shoe with a pocket design as shown in FIGS. 4A and 4B and further including abrasion-resistant rods inserted in the impeller shoe.

FIG. 5 illustrates a top view of the impeller shoe 70 shown in FIGS. 4A and 4B. In FIG. 5, the pockets 84, 86 and bolt holes 100 for securing the impeller shoe 70 to a bracket (see FIG. 3) are shown in phantom using dotted lines. The top surface 102 of the impeller shoe 70 is substantially flat and overlays the pockets 84, 86 to form the upper lip 96 shown in FIG. 4A. FIG. 6 is a top section view of an impeller shoe 104 similar to the impeller shoe 70 shown in FIGS. 4A and 4B and FIG. 5, with abrasion-resistant rods 106 (discussed below) inserted in the impeller shoe 104 to further extend the wear life of the shoe. FIG. 6 more clearly illustrates the pockets formed according to the present invention, and shows the lower lip 98 not visible in FIG. 5.

As described earlier, the pockets 84, 86 are substantially even in width and are set at an angle with respect to the back of the impeller shoe 70 to face toward the flow of aggregate material. If more than one pocket is defined in the impeller shoe, as shown in FIGS. 4–7, it is not required that the pockets 84, 86 be set at the same angle with respect to the back 78 of the impeller shoe 70. In particular, as shown in FIG. 5, the first pocket 84 is shown at an angle $\alpha$ of 45° from the back plane 108 of the impeller shoe 70. The second pocket 86 is shown defined at an angle $\beta$ of 30° from the back plane 108 of the impeller shoe 70. These particular angles $\alpha$, $\beta$ are illustrative only; the pockets may each be set at other angles toward the inner end 74, depending on the particular application in which the impeller shoe may be used.

To improve the packing of the pockets, the width of the pockets 84, 86 is preferably narrow in comparison to the longitudinal width of the impeller shoe 70. In one actual embodiment of the impeller shoe having a longitudinal width of approximately ten and one-half inches, the pockets are defined with an even width of approximately one and one-half inches (i.e., the width of the pockets are less than 15% of the longitudinal width of the impeller shoe). If the impeller shoe includes more than one pocket, it is not required that each of the pockets have the same width as the other pockets, that is, one of the pockets may have a different width than another pocket.

FIG. 7 is a top view of an impeller table 28 with impeller shoes 110, 112 formed according to the present invention mounted thereon. In operation, particulate material falling onto the feed disc 50 first impacts the toe 114 of an impeller shoe 110. The particulate material is often broken apart by the forces of this impact into an aggregate that is sprayed back toward a following impeller shoe 112. As illustrated in FIG. 7, the following impeller shoe 112 includes two pockets 116, 118 that are filled with crushed aggregate 120 that provide a protective surface to the impeller shoe 110, 112. The aggregate 120 sprayed from the toe 114 of the leading impeller shoe 110 may impact the following impeller shoe 112 multiple times before the aggregate is thrown outward away from the impeller table 28 against stationary anvils (not shown in FIG. 7) surrounding the impeller table.

Figure 1:
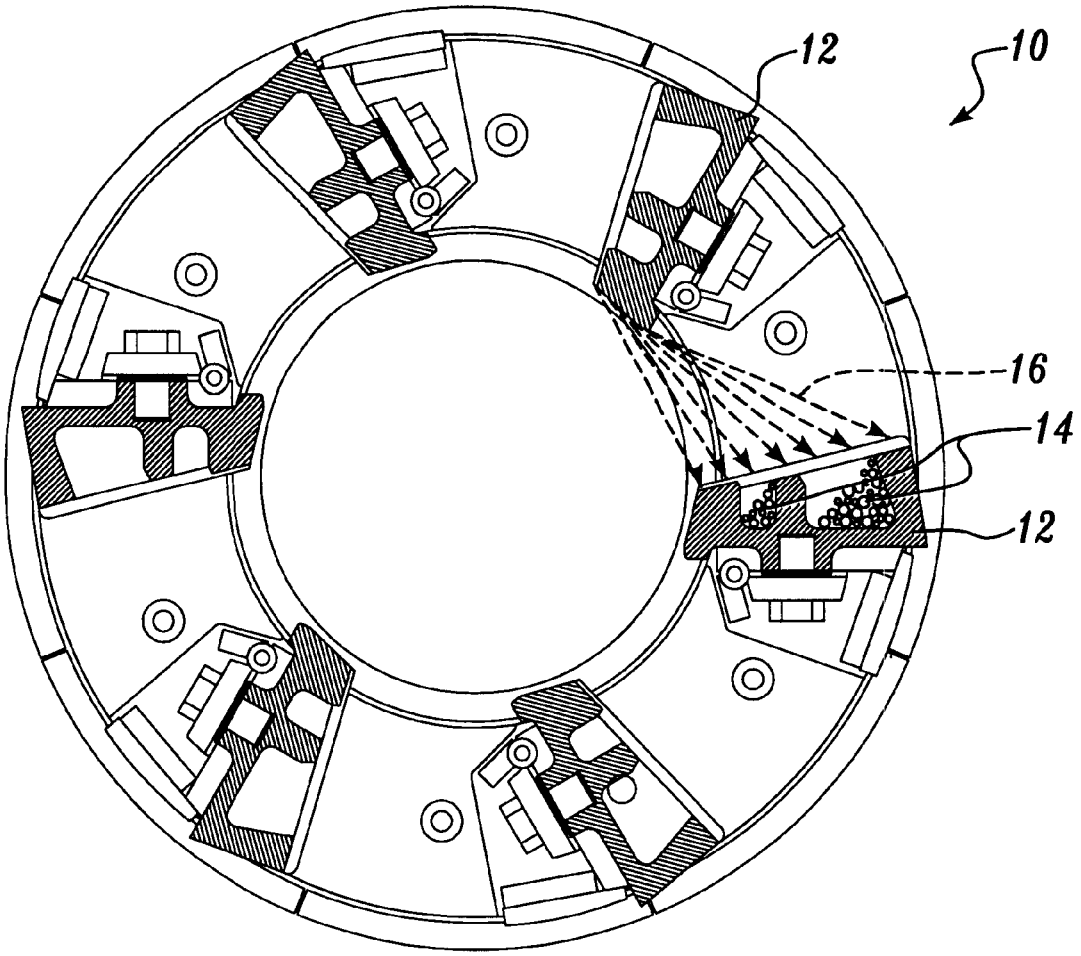
Fig. 1 (PRIOR ART)
FIG. 1 is a top view of an impeller table assembly having prior art impeller shoes mounted thereon.

Because the pockets 116, 118 of the impeller shoe 112 are narrow in comparison to the longitudinal width of the impeller shoe, the impeller shoe 112 does not weigh substantially less than a solid impeller shoe (e.g., as shown in FIG. 9). The impeller shoe 110, 112 of the present invention preferably possesses a stability and crushing capacity similar to that of a solid impeller shoe. The impeller shoe 110, 112 also does not impose limitations on size of material fed to the crushing machine 20 as prior art pocketed impeller shoes 12 have imposed (e.g., as shown and discussed with respect to FIG. 1).

Another advantage of the present invention is that moisture is not required for full packing of the pockets 116, 118. As noted earlier, prior art pocketed impeller shoes 12 require moisture in the particulate material for the resulting crushed aggregate to more fully pack the pockets. In the present invention, the pockets 116, 118 may fully pack with dry aggregate material. Consequently, the impeller shoes 110, 112 of the present invention are not subject to the increased wear that wet aggregate material causes to impeller shoes.

Another advantage of an impeller shoe constructed according to the present invention is that the impeller shoe provides a full face wear with a wider wear pattern top to bottom of the impeller shoe. As aggregate material impacts and moves along the front face 80 of an impeller shoe 70, the material of the impeller shoe 70 is slowly worn away. In prior art impeller shoes, such as the impeller shoes 12 shown in FIG. 1, the wear pattern top to bottom of the impeller shoes becomes increasingly uneven over time, thus leading to an increasingly narrow spray of aggregate from the impeller shoes to the anvils surrounding the impeller table. This uneven wear pattern not only decreases the life of the impeller shoes 12, it also requires more frequent adjustment of the anvils in order to even out the wear of the anvils.

In the present invention, the impeller shoes 70 successfully maintain a wider wear pattern top to bottom for wider spray of material from the impeller shoes 70 to the anvils. The impeller shoes 70 of the present invention thus enjoy a longer wear life and reduce the need to adjust the anvils in order to even the wear of the anvils.

Yet another advantage of the present invention is that, over time, the reduction ratio of the particulate matter does not vary with the wear of the impeller shoes 70. With the prior art impeller shoes 12, the reduction ratio decreased over time (as compared to the use of solid impeller shoes). Again, in this respect, the impeller shoes 70 of the present invention retain many of the advantages of a solid impeller shoe while extending the life of the impeller shoes 70 by use of the unique pocketed design.

To further extend the wear life of an impeller shoe, one or more rods made of a highly abrasive-resistant material, such as carbide or ceramic, may also be inserted into the impeller shoe. For instance, in FIG. 6, one or more abrasion-resistant rods 106 may be inserted in the toe 122 of the impeller shoe 104 near the inner end and in the heel 126 near the outer end, as well as in the mid-portion 124 of the shoe 104 between the pockets. The abrasion-resistant rods 106 are embedded within the material of the impeller shoe 104, but when the outer surface of the impeller shoe 104 is worn away, a portion of the abrasion-resistant rod 106 is exposed to the impact of the aggregate material being crushed. Because the abrasion-resistant rods 106 have a higher resistance to abrasion, the abrasion-resistant rods 106 are worn away at a slower rate than the material of the impeller shoe 104, thus extending the life of the impeller shoe 104.

The abrasion-resistant rods 106 may be embedded in the material of the impeller shoe by drilling one or more cores into the impeller shoe 104 and inserting the abrasion-resistant rods 106 into the hollow cores. Dust from the crushing operation of the machine 20 may fill in the gap between the abrasion-resistant rods and the impeller shoe material to secure the abrasion-resistant rods 106 in the impeller shoe 104, in addition to the securing centrifugal forces of the rotating impeller table 28. Alternatively, the abrasion-resistant rods 106 may be embedded in the impeller shoe 104 during a casting process in which the shoe 104 is formed by positioning the abrasion-resistant rods in a casting form prior to the casting process.

FIGS. 8A and 8B are provided to illustrate impeller shoes 128, 130 constructed in accordance with the present invention and include a single pocket. In FIG. 8A, the pocket 132 is positioned toward the toe 134 of the impeller shoe 128, while in FIG. 8B, the pocket 136 is positioned toward the heel 138 of the impeller shoe 130. The positioning of the pockets 132, 136 in FIGS. 8A and 8B is illustrative only; the pockets may be positioned anywhere along the front of the impeller shoe. As shown in FIGS. 8A and 8B, the sides 140, 142, and 144, 146 of the pockets 132, 136 are substantially parallel and are preferably narrow in comparison to the longitudinal width of the impeller shoes 128, 130.

FIG. 8A also illustrates potential locations at which abrasion-resistant rods 138 may be inserted into the impeller shoe 128 to increase the wear life the impeller shoe. As indicated earlier, the abrasion-resistant rods 138 are embedded within the impeller shoe 128 to improve the wear life of the shoe.

FIG. 9 illustrates a solid impeller shoe 150 that includes one or more abrasion-resistant rods 152 inserted in the impeller shoe in accordance with the present invention to improve the wear life of the shoe 150. Again, the illustrated number and locations of the abrasion-resistant rods shown in FIGS. 6, 8A, and 9 are not intended to limit the scope of the invention with respect to embedding rods made of higher abrasion-resistant material in the impeller shoe material.

While preferred embodiments of the invention have been described and shown herein, it will be appreciated that various changes may be made to the impeller shoe without departing from the spirit and scope of the present invention. For instance, as shown in FIGS. 8A and 8B, impeller shoes 128, 130 are shown having a single pocket instead of the two-pocket design of impeller shoes 70, 104, 110, 112 shown in FIGS. 4–7, demonstrating that various numbers of pockets may be used. Furthermore, the location of abrasion-resistant rods inserted into the impeller shoe, if any, may vary according to the design and particular application for the impeller shoe.

The embodiments of the invention in which an exclusive property or privilege is claimed are defined as follows:

1. An impeller shoe for use in an impact crushing machine, comprising:

an elongated body of abrasion-resistant material formed for mounting on a rotatable impeller table of the impact crushing machine, the elongated body extending longitudinally from an inner end that, when mounted, is positioned toward the center region of the impeller table, to an outer end that, when mounted, is positioned toward the edge of the impeller table, the elongated body having a back and a front extending longitudinally between the inner end and the outer end of the elongated body, wherein a pocket is defined in the elongated body, the pocket having an open end at the front of the elongated body and two opposing sides extending transversely in the elongated body toward the back of the body, the two opposing sides of the pocket being oriented substantially parallel to each other and set at an angle with respect to the back of the body in a direction toward the inner end so that the pocket faces toward the center region of the impeller table, the pocket having a substantially even width measured orthogonally between the two opposing sides through the length of at least one side of the pocket.

2. The impeller shoe of claim 1, further comprising a stob projecting from the back of the elongated body for securing the impeller shoe to an impeller table assembly.

3. The impeller shoe of claim 1, further comprising a lip projecting transversely outward from the front of the elongated body and extending longitudinally along the front of the elongated body.

4. The impeller shoe of claim 1, further comprising an abrasion-resistant rod having a higher abrasion resistance than the material of which the impeller shoe is formed, the abrasion-resistant rod being embedded in the material of which the impeller shoe is formed.

5. The impeller shoe of claim 4, wherein the abrasion-resistant rod is formed of a carbide material.

6. The impeller shoe of claim 4, wherein the abrasion-resistant rod is formed of a ceramic material.

7. The impeller shoe of claim 1, wherein the width of the pocket is narrow in comparison to the longitudinal width of the impeller shoe.

8. An impeller shoe for use in an impact crushing machine, comprising:

an elongated body of abrasion-resistant material formed for mounting on a rotatable impeller table of the impact crushing machine, the elongated body extending longitudinally from an inner end that, when mounted, is positioned toward the center region of the impeller table, to an outer end that, when mounted, is positioned toward the edge of the impeller table, the elongated body having a back and a front extending longitudinally between the inner end and the outer end of the elongated body, wherein a plurality of pockets are defined in the elongated body, each pocket in the plurality of pockets having an open end at the front of the elongated body and two opposing sides extending transversely in the elongated body toward the back of the body, the two opposing sides of each pocket being oriented substantially parallel to each other and set at an angle with respect to the back of the body in a direction toward the inner end so that the pocket faces toward the center region of the impeller table, each pocket having a substantially even width measured orthogonally between the two opposing sides through the length of at least one side of the pocket.

9. The impeller shoe of claim 8, wherein the opposing sides of one of the pockets in the plurality of pockets is set at a different angle than the angle of the opposing sides of another pocket in the plurality of pockets.

10. The impeller shoe of claim 8, wherein the width of one of the pockets in the plurality of pockets is different than the width of another pocket in the plurality of pockets.

11. A method of forming an impeller shoe for use in an impact crushing machine, comprising:

forming an elongated body of abrasion-resistant material for mounting on a rotatable impeller table of the impact crushing machine, the elongated body extending longitudinally from an inner end that, when mounted, is positioned toward the center region of the impeller table, to an outer end that, when mounted, is positioned toward the edge of the impeller table, the elongated body having a back and a front extending longitudinally between the inner end and the outer end of the elongated body; and defining a pocket in the elongated body, the pocket having an open end at the front of the elongated body and two opposing sides extending transversely in the elongated body toward the back of the body, the two opposing sides of the pocket being oriented substantially parallel to each other and set at an angle with respect to the back of the body in a direction toward the inner end so that the pocket faces toward the center region of the impeller table, the pocket having a substantially even width measured orthogonally between the two opposing sides through the length of at least one side of the pocket.

12. The method of claim 11, wherein a casting process is used to form the elongated body and define the pocket in the elongated body.

13. The method of claim 11, wherein the pocket defined in the elongated body is a first pocket, the method further comprising defining a second pocket in the elongated body, the second pocket having an open end at the front of the elongated body and two opposing sides extending transversely in the elongated body toward the back of the body, the two opposing sides of the second pocket being oriented substantially parallel to each other and set at an angle with respect to the back of the body in a direction toward the inner end, the second pocket having a substantially even width measured between the two opposing sides through the length of the second pocket.

14. The method of claim 13, wherein the opposing sides of the first pocket are set at an angle different than the angle of the opposing sides of the second pocket.

15. The method of claim 13, wherein the width of the first pocket is different than the width of the second pocket.

16. The method of claim 11, further comprising embedding an abrasion-resistant rod in the material of which the impeller shoe is formed, the abrasion-resistant rod having a higher abrasion resistance than the material of which the impeller shoe is formed.

17. The method of claim 16, wherein embedding the abrasion-resistant rod in the impeller shoe comprises forming a bore in the material of the impeller shoe and inserting the rod into the bore.

18. The method of claim 16, wherein embedding the abrasion-resistant rod in the impeller shoe comprises positioning the rod in a casting form prior to forming the impeller shoe in a casting process.

19. The method of claim 11, wherein defining the pocket in the elongated body further comprises defining the width of the pocket to be narrow in comparison to the longitudinal width of the impeller shoe.

* * * * *